US006170114B1

(12) United States Patent
Woodnorth et al.

(10) Patent No.: US 6,170,114 B1
(45) Date of Patent: Jan. 9, 2001

(54) LIQUID COATING APPLICATOR

(75) Inventors: Brian E. Woodnorth, Whitefish Bay; Kenneth L. Shehow, Milwaukee; Scott I. Biba, Mazomanie; Scott P. Sullivan, Madison; William C. Lindeman, Marshall, all of WI (US)

(73) Assignee: Newell Operating Company, Freeport, IL (US)

( * ) Notice: Under 35 U.S.C. 154(b), the term of this patent shall be extended for 0 days.

(21) Appl. No.: 09/134,505

(22) Filed: Aug. 14, 1998

(51) Int. Cl.[7] ..... B05C 17/00
(52) U.S. Cl. ..... 15/210.1; 15/228
(58) Field of Search ..... 15/209.1, 210.1, 15/228, 244.1, 244.3

(56) References Cited

U.S. PATENT DOCUMENTS

| | | | | |
|---|---|---|---|---|
| 124,410 | | 3/1872 | Wilson et al. | 401/139 |
| 815,343 | * | 3/1906 | Garnet | 15/228 |
| 2,682,071 | | 6/1954 | Linderoth | 15/147.2 |
| 2,722,704 | | 11/1955 | Warden | 15/153 |
| 2,876,476 | * | 3/1959 | Woods | 15/244.1 X |
| 2,961,681 | * | 11/1960 | Terzian | 15/209.1 |
| 3,090,985 | * | 5/1963 | Baum | 15/244.1 |
| 3,117,334 | * | 1/1964 | Imhof | 15/210.1 |
| 3,388,415 | * | 6/1968 | Warner et al. | 15/210.1 X |
| 3,414,929 | * | 12/1968 | Warner et al. | 15/210.1 X |
| 3,629,894 | * | 12/1971 | Stefany | 15/210.1 X |
| 3,717,896 | * | 2/1973 | Chase et al. | 15/210.1 |
| 4,032,239 | | 6/1977 | Maupin | 401/203 |
| 4,127,911 | * | 12/1978 | Cupp et al. | 15/210.1 |
| 4,134,173 | * | 1/1979 | Cupp et al. | 15/210.1 |
| 4,300,258 | * | 11/1981 | Burns et al. | 15/210.1 |
| 4,819,294 | * | 4/1989 | Calvert | 15/210.1 X |
| 5,122,056 | | 6/1992 | Barbee | 433/80 |
| 5,312,197 | | 5/1994 | Abramson | 401/6 |
| 5,349,716 | | 9/1994 | Millar | 15/245 |
| 5,426,809 | | 6/1995 | Muta | 15/228 |
| 5,477,582 | * | 12/1995 | Yamashita | 15/228 X |
| 5,609,255 | * | 3/1997 | Nichols | 15/228 X |

FOREIGN PATENT DOCUMENTS

| | | | | |
|---|---|---|---|---|
| 2308253 | * | 8/1974 | (DE) | 15/210.1 |
| 447889 | * | 5/1936 | (GB) | 15/244.1 |

* cited by examiner

*Primary Examiner*—Mark Spisich
(74) *Attorney, Agent, or Firm*—Foley & Lardner

(57) ABSTRACT

A liquid coating applicator includes a support of a pad coupled to the support. The pad has a front side, a rear side and a lower arcuate convex surface between the front side and the rear side to spread coatings. Preferably, the support has at least one pad engaging surface configured to engage the pad and to support the pad in the arcuate convex cross-sectional shape. Preferably, the pad includes a backing configured for being removably coupled to the support, a substrate having a front arcuate side, a rear arcuate side and a lower surface between the front and rear sides and a flocking material coupled to the substrate. The backing and the substrate have the arcuate convex shape upon being coupled to the support.

26 Claims, 5 Drawing Sheets

10
12
14
18
19
20
24
26
28
36
38
40
42
52
54
56
58
62
64
66
68
70
9
11

LIQUID COATING APPLICATOR

FIELD OF THE INVENTION

The present invention relates to liquid coating applicators for applying liquid coatings such as paints, varnishes, liquid sealants, stains and the like to surfaces. In particular, the present invention relates to a liquid coating applicator having an arcuate convex application surface for spreading liquid coatings across larger surface areas.

BACKGROUND OF THE INVENTION

Liquid coating applicators are typically used to apply and spread liquid coatings such as paints, varnishes, stains and liquid sealants to different surfaces such as walls, ceilings, and floors. Floors, such as decks and driveways, are coated using a relatively large liquid applicator. Liquid applicators used to apply coatings to floors, decks and driveways comprise either an elongate roller or a flat pad. Roller applicators typically comprise an elongate, cylindrical roller having a covering of liquid absorbing cloth or nap and mounted to the end of an elongate handle or pole. As the roller is pushed across the floor, deck or driveway, the roller rolls and dispenses the coating across the surface. Because the roller rolls along the surface, the roller is easy to push with very little friction. However, due to its circular shape and practical size limitations, the roller maintains contact with the surface along only a single line having a severely limited surface area. As a result, the roller applicator does not consistently spread the coating across the surface.

Flat pad applicators typically comprise an elongate, generally rectangular flat foam or sponge pad mounted to the end of an elongate handle or pole. In contrast to roller applicators, flat pad applicators have a large surface area adapted to contact the surface being coated. Unfortunately, to maintain the large surface area of the flat pad applicator in contact with the surface being coated requires that the flat pad be perfectly parallel with the floor, deck or driveway. During the back and forth sweeping motion of the applicator, it is extremely difficult to maintain the flat pad perfectly parallel with the surface being coated. The difficulty of maintaining the flat pad perfectly parallel with the floor, deck or driveway is further increased because conventional flat pad applicators are not designed to accommodate users having different heights. It has been found that extremely tall or extremely short users tend to elevate either the front or the rear of the flat pad relative to the floor, deck or driveway. If the flat pad is not maintained perfectly parallel with the floor, deck or driveway, the flat pad contacts the surface being coated along only a single line of contact. Consequently, despite having a large surface area adapted to contact the surface being coated, flat pad applicators rarely achieve greater surface contact than roller applicators. Thus, neither roller applicators nor flat pad applicators consistently spread coating across surfaces.

Thus, there is a continuing need for a liquid coating applicator that contacts the floor, deck or driveway with a relatively large surface area and that is easily maintained in contact with the floor, deck or driveway during to and fro movement of the applicator across the floor, deck or driveway, regardless of the user's stature. There is also a continuing need for a relatively large liquid coating applicator which is easily moved across a floor, deck or driveway with minimal frictional resistance.

SUMMARY OF THE INVENTION

The present invention is directed to a liquid coating applicator which includes a support and a pad coupled to the support. The pad has a front side, a rear side and a lower arcuate convex surface between the front side and the rear side to spread coatings.

According to first aspect of the present invention, the arcuate convex surface has a radius of at least 5 inches and less than 27 inches. According to a more preferred embodiment, the arcuate convex surface has a radius of between about 12 inches and about 20 inches.

According to a second aspect of the liquid coating applicator, the pad includes a backing configured to be coupled to the support and a flocking material coupled to the backing. The pad preferably additionally includes a substrate coupled to the backing, wherein the flocking material is coupled to the substrate. The backing and the substrate are preferably flexible. In addition, the support preferably includes at least one pad engaging surface configured to engage the pad and to support the pad in an arcuate convex cross-sectional shape. The support preferably includes a plurality of spaced ribs, wherein each rib has an arcuate convex surface in engagement with the pad.

According to a third aspect of the coating applicator, the pad is removably coupled to the support. Preferably, the pad slidably mounts to the support. In one exemplary embodiment, the pad includes a plurality of resiliently flexible pads that form a channel to releasably receive the support.

According to yet a fourth aspect of the coating applicator, the applicator includes an elongate pole and a support includes a mounting portion configured to be coupled to the pole.

According to yet a fifth aspect of the coating applicator, the support includes a first wall portion extending from the pad, a second wall portion extending from the pad and a third wall portion interconnecting the first and second wall portions opposite the pad.

The present invention is further directed to a coating applicator support for use with an applicator pad. The support includes a body having at least pad engaging surface. The at least one pad engaging surface is configured to engage the pad and to support the pad in an arcuate convex cross-sectional shape.

Preferably, the applicator support includes a plurality of spaced ribs. Each rib includes at least one pad engaging surface. The at least one pad engaging surface is preferably configured to support the pad in an arcuate convex cross-sectional shape having a radius between 5 inches and 27 inches. Preferably, the at least one pad engaging surface supports the pad in an arcuate convex cross-sectional shape having a radius of between 12 and 20 inches.

The present invention is also directed to a coating applicator pad for use with a pad support. The pad includes a backing configured for being removably coupled to the support, a substrate having a front arcuate side, a rear arcuate side and a lower surface between the front and rear sides and flocking coupled to the substrate. The backing and the substrate are configured so as to have an arcuate convex shape upon being coupled to the support. Preferably, the backing and the substrate are resiliently flexible so as to resiliently deform to the arcuate convex shape upon being coupled to the support.

DETAILED DESCRIPTION OF THE PREFERRED EMBODIMENTS

Figure 1:
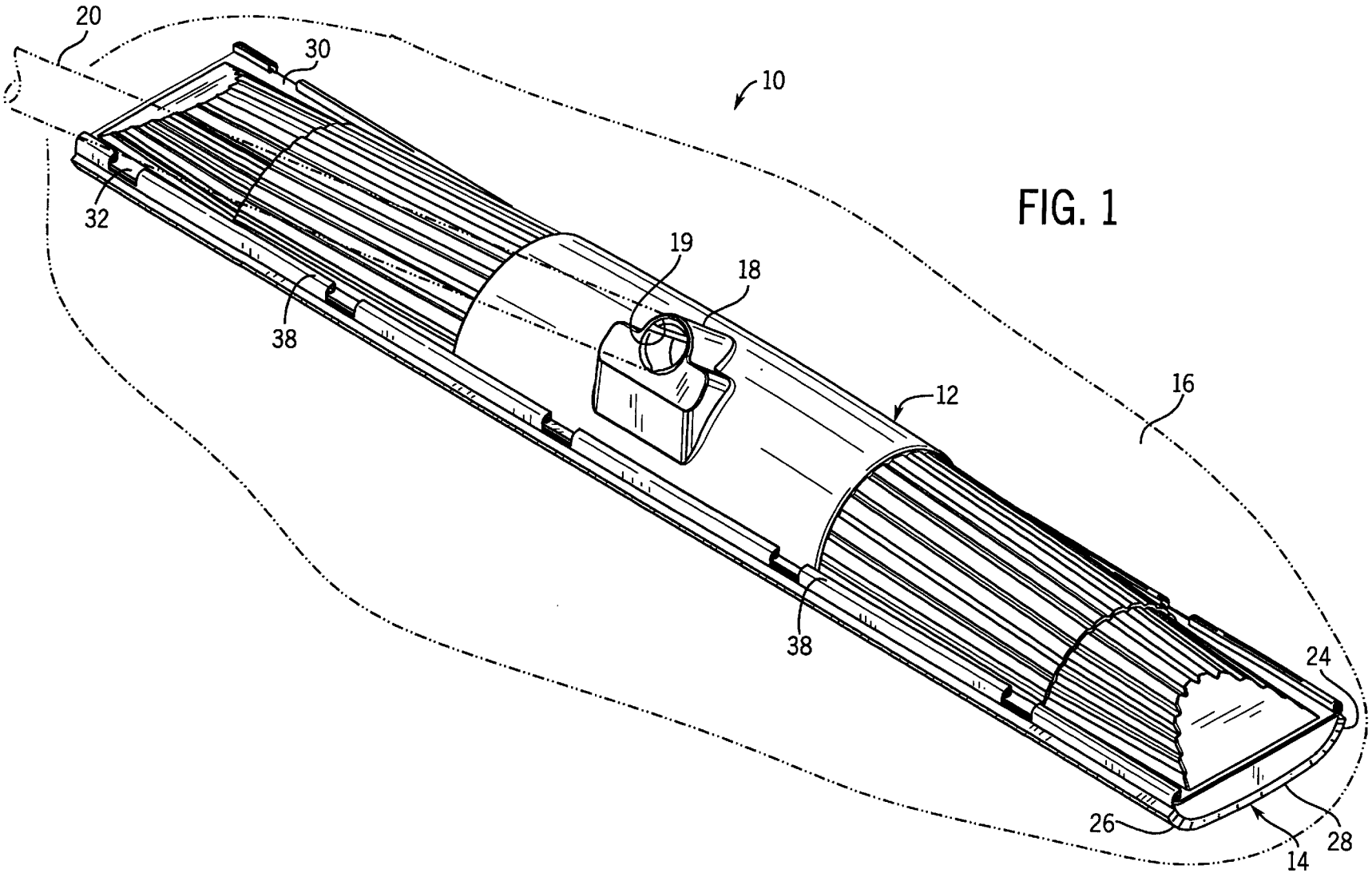
FIG. 1 is a top perspective view of a liquid coating applicator of the present invention.
Figure 2:
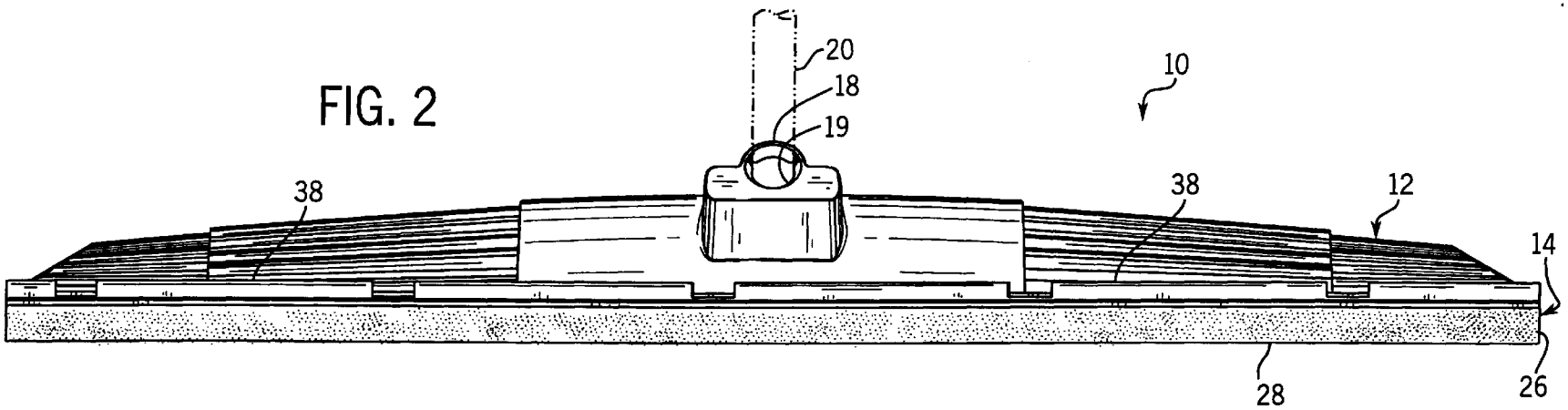
FIG. 2 is a front elevational view of the liquid coating applicator of FIG. 1.
Figure 3:
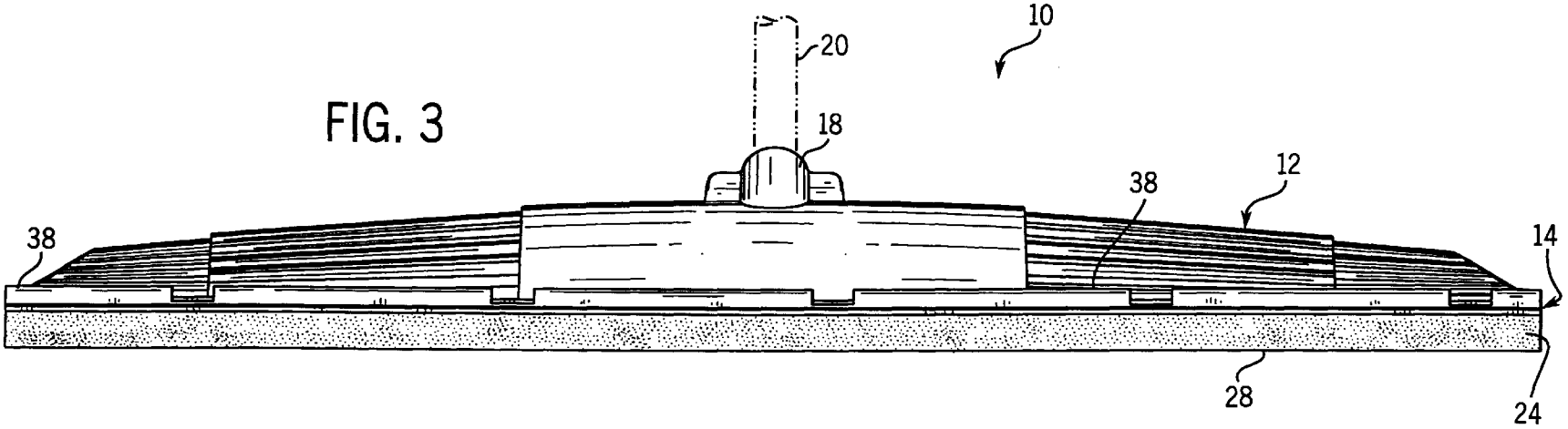
FIG. 3 is a rear elevational view of the liquid coating applicator of FIG. 1.
Figures 4, 5, 6, 9:
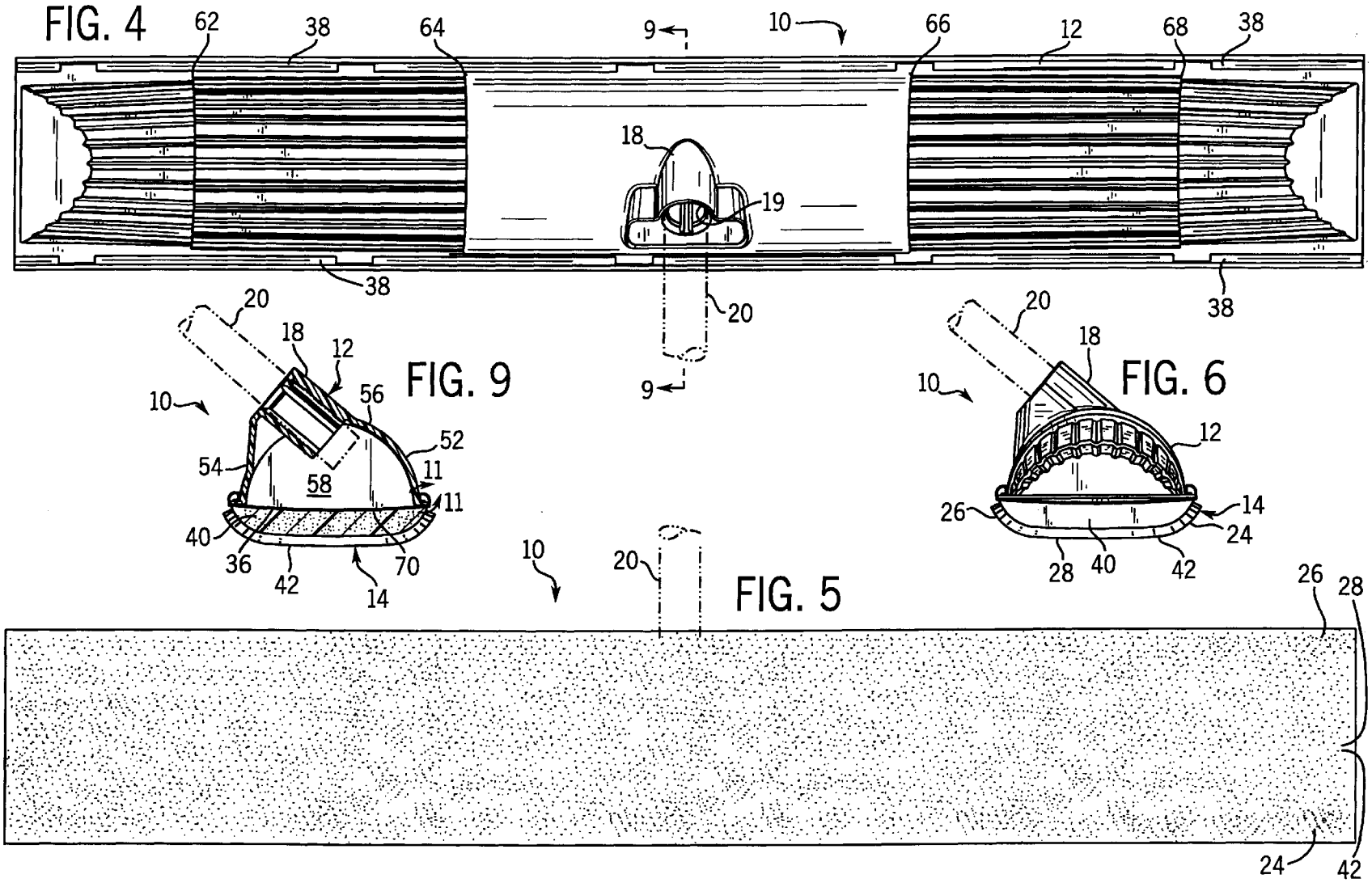
FIG. 4 is a top plan view of the liquid coating applicator of FIG. 1.
FIG. 5 is a bottom plan view of the liquid coating applicator of FIG. 1.
FIG. 6 is a right side elevational view of the liquid coating applicator of FIG. 1.
FIG. 9 is a sectional view of the liquid coating applicator of FIG. 4 taken along lines 9—9.

FIGS. 1–6 illustrate an assembled liquid coating applicator 10. FIG. 1 is a top perspective view of liquid coating applicator 10. FIG. 2 is a front elevational view of the liquid coating applicator. FIG. 3 is a rear elevational view of the liquid coating applicator. FIG. 4 is a top plan view of the liquid coating applicator. FIG. 5 is a bottom plan view of the liquid coating applicator. FIG. 6 is a right side elevational view of the liquid coating applicator, the left side elevational view of the coating applicator being a mirror image thereof. As best shown by FIGS. 1–6, coating applicator 10 generally includes support 12 and pad 14. Support 12 is an elongate, relatively rigid member configured for supporting pad 14 as pad 14 is moved across surface 16. Support 12 includes a mounting portion 18 configured for mounting support 12 to an elongate pole 20 having a handle portion (not shown). As best shown by FIGS. 1 and 9, mounting portion 18 preferably includes a central sleeve or bore 19 sized for receiving an end of pole 20. Although mounting portion 18 is specifically adapted to removably couple support 12 to pole 20, mounting portion 18 may alternatively be adapted for permanently coupling support 12 to pole 20.

As further shown by FIGS. 1–6, support 12 has a longitudinal length substantially equal to the longitudinal length of pad 14. Although support 12 is preferably designed as shown in FIGS. 1–6 so as to support pad 14 while providing a sleek, robust and visually attractive appearance, support 12 may have other various sizes, shapes and configurations. For example, in the exemplary embodiment illustrated, support 12 is configured to support a 24 inch pad. In particular, support 12 preferably has a length of approximately 24.13 inches and a width of approximately 3.344 inches. Pad 14 has a length of approximately 23.75 inches and a width of approximately 3.56 inches. To accommodate shorter pads, such as 18 inch pads, or longer pads, such as 32 inch pads, support 12 may be modified as necessary. As will be appreciated, both support 12 and pad 14 must have a minimum longitudinal length of at least 12 inches to efficiently coat larger surfaces, such as floors, decks and driveways. In the exemplary embodiment illustrated, support 12 is specifically configured for being removably coupled to pad 14. Alternatively, support 12 may be configured for being permanently attached to pad 14.

Pad 14 is an elongate, paint carrying, releasing and spreading medium which is carried and supported by support 12 substantially along the entire longitudinal length of support 12. Pad 14 is configured for being removably coupled to support 12. Alternatively, pad 14 may be configured for being permanently coupled to support 12. Pad 14 generally includes a front side 24, a rear side 26 and a lower arcuate surface 28. Front side 24 and rear side 26 extend opposite one another substantially parallel to the longitudinal axis of pad 14 and support 12. As a result, front side 24 and rear side 26 spread liquid coating across surface 16 as applicator 10 is pushed and pulled to and fro across surface 16. Front side 24 and rear side 26 preferably have an arcuate convex shape to spread excess coating on the front and rear sides of pad 14.

Lower surface 28 extends between front side 24 and rear side 26 of pad 14. Lower surface 28 is preferably configured so as to have an arcuate convex cross-sectional shape when mounted to support 12. Because surface 28 has an arcuate convex cross-sectional shape, surface 28 enables the user of applicator 10 to more consistently maintain a larger surface area of pad 14 in contact with surface 16 during the application of liquid coating. In particular, because surface 28 has an arcuate convex cross-sectional shape, a greater surface area of surface 28 is kept in contact with surface 16 even when applicator 10 is tilted either towards the front or the rear during to and fro sweeping movement of applicator 10 across surface 16 by users having different statures. Surface 28 preferably has a radius of at least 5 inches. It has been found that with this minimum radius, surface 28 and pad 14 more consistently maintain an enlarged surface area in contact with surface 16 independent of variations caused by to and fro movement of applicator 10 as well as the use of applicator 10 by different users having different statures. Surface 28 preferably has a maximum radius of about 27 inches. At this maximum radius, surface 28 of pad 14 has a larger surface area in contact with surface 16 as compared to the minimum radius of 5 inches. However, with this maximum radius, surface 28 is less accommodating to the variations caused by to and fro movement of applicator 10 as well as variations caused by different users having different statures. It has been found that the optimum range of radii for surface 28 falls between 12 inches and 20 inches. Within this range, surface 28 maintains an acceptable amount of surface area in contact with surface 16 while still adequately adapting to angular variations caused by the to and fro movement of applicator 10 and the use of applicator 10 by different users having different statures. In the exemplary embodiment illustrated, surface 28 is configured so as to have an arcuate convex cross-sectional shape of approximately 21 inches. With this exemplary embodiment, the ability of applicator 10 to accommodate different users having different statures has been sacrificed slightly in favor of an increased amount of surface area of surface 28 in contact with surface 16. Overall, applicator 10 consistently maintains an enlarged surface area of its applicating surface carrying liquid coatings in contact with surface 16 to more uniformly spread and apply the coatings to surface 16 despite angular variations of pad 14 relative to surface 16.

Figure 7:
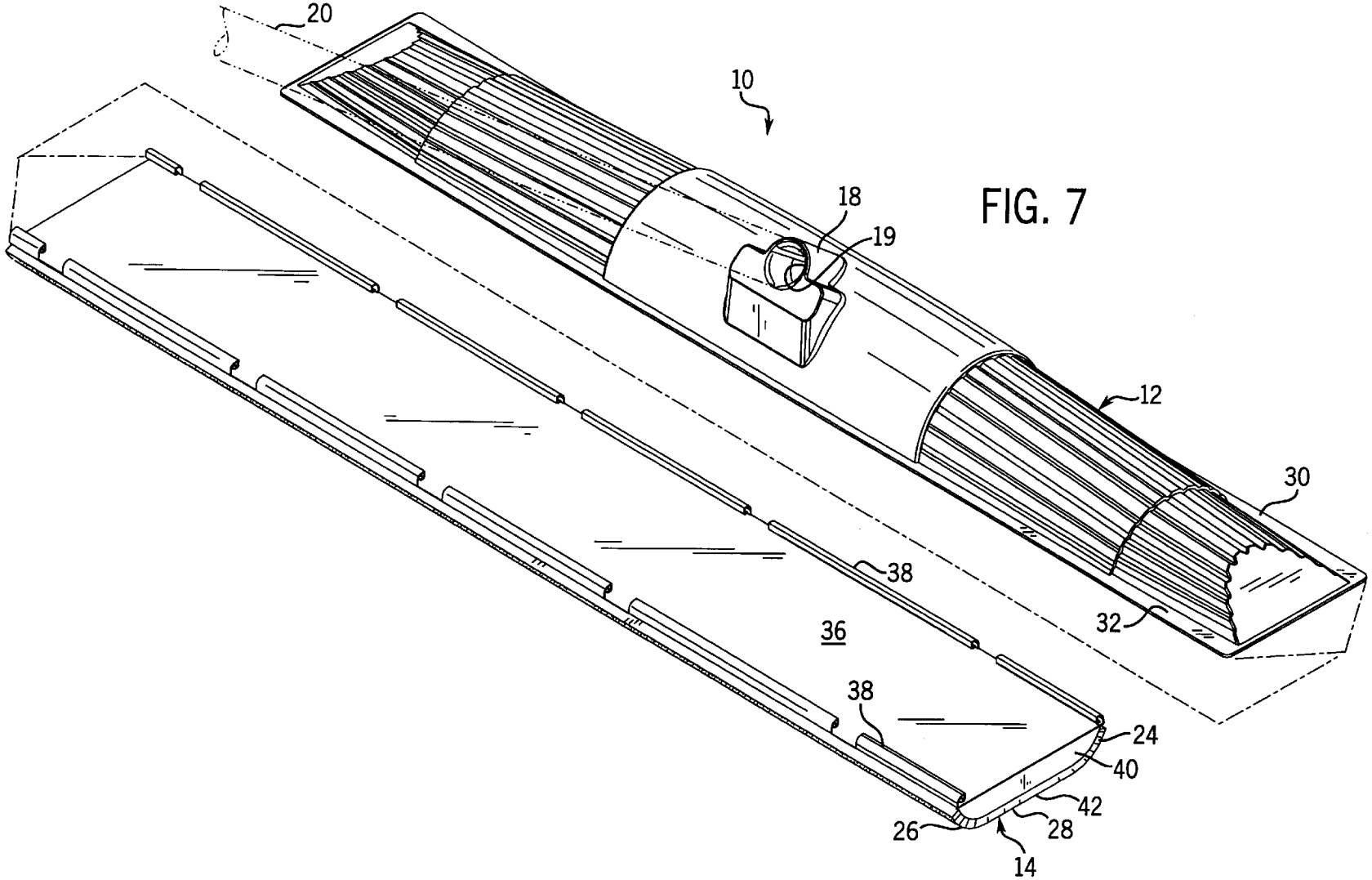
FIG. 7 is an exploded perspective view of the liquid coating applicator of FIG. 1 illustrating a pad separated from a support.
Figure 8:
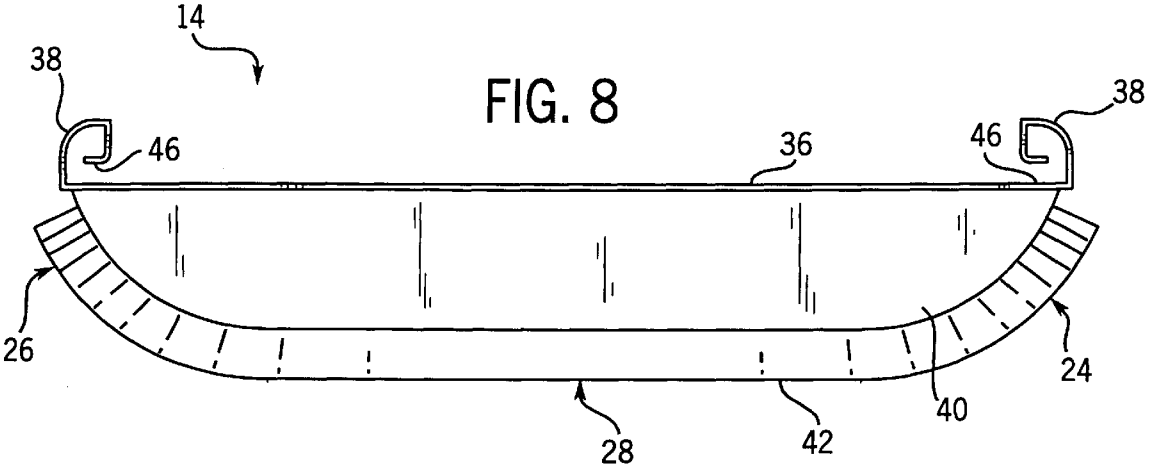
FIG. 8 is an enlarged and elevational view of the pad of FIG. 7.
Figure 10:
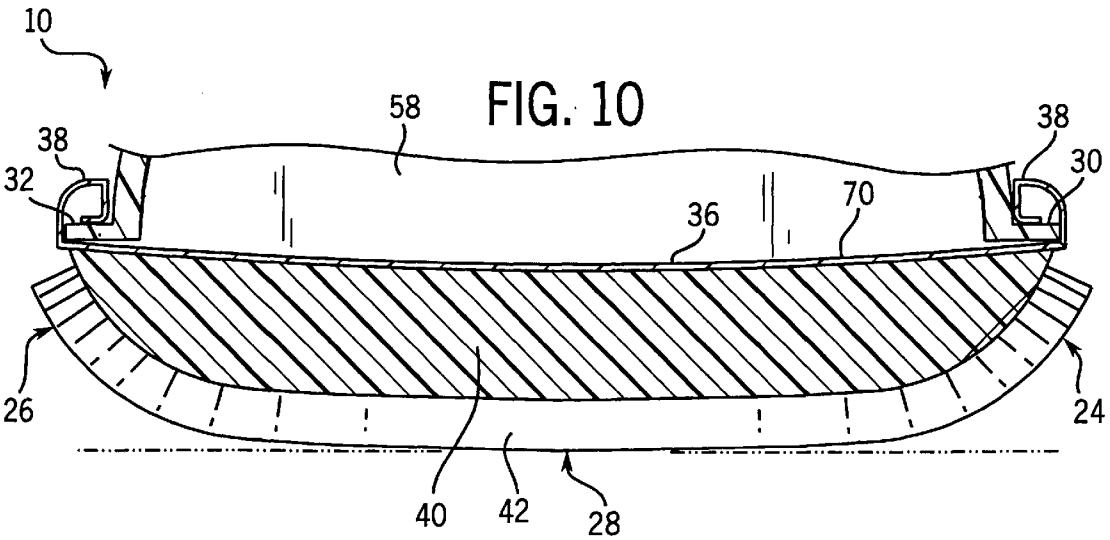
FIG. 10 is an enlarged fragmentary sectional view of the liquid coating applicator of FIG. 9.

FIGS. 7–11 illustrate liquid coating applicator 10 in greater detail. In particular, FIG. 7 is an exploded perspective view of applicator 10 illustrating pad 14 removed from support 12. FIG. 8 is an enlarged end elevational view of pad 14 removed from support 12. FIGS. 9–10 are sectional view illustrating pad 14 mounted to support 12. As best shown by FIG. 7, pad 14 is removably coupled to support 12. In particular, pad 14 is slid onto and off of support 12. To this end, support 12 includes outwardly projecting front and rear flanges 30 and 32, respectively. Although flanges 30 and 32 may have any one of a variety of shapes, sizes and configurations, flanges 30 and 32 are specifically configured to slidably engage pad 14 so as to releasably couple pad 14 to support 12.

As shown by FIGS. 7 and 8, pad 14 is configured for being slidably coupled to support 12. Pad 14 generally includes backing 36, mounting tabs 38, substrate 40 and applicating medium 42. Backing 36 is an elongate member configured for being positioned adjacent to support 12. Backing 36 carries and supports substrate 40 as well as applicating medium 42. Backing 36 preferably has a thickness and is preferably made from a material such that backing 36 is resiliently flexible so as to resiliently deform when coupled to and engaged by support 12. Backing 36 preferably comprises rigid polychloride having a thickness of about 0.020 inches. Alternatively, backing 36 may comprise a variety of other well-known resiliently flexible materials. Alternatively, backing 36 may be formed of a more rigid in flexible material, wherein backing 36 is preformed so as to support substrate 40 and applicating medium 42 such that surface 28 of applicating medium 42 has an arcuate convex cross-sectional shape or contour. For example, backing 36 may be preformed so as to have an arcuate convex cross-sectional shape or contour prior to being mounted to support 12, wherein the rigid structure of backing 36 provides least applicating medium 42 with an arcuate convex shape along surface 28.

Figure 11:
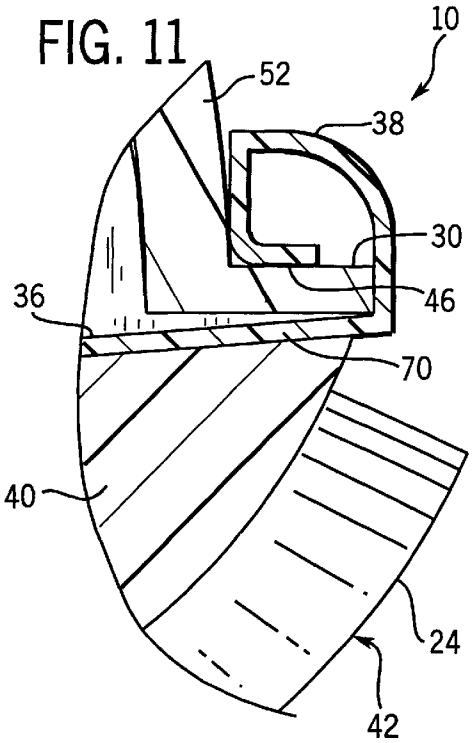
FIG. 11 is an enlarged fragmentary sectional view of the coating applicator of FIG. 9 taken along lines 11—11.

Mounting tabs 38 comprise protuberances or flanges that project away from backing 36 so as to form a channel 46 sized and configured for slidably receiving flanges 30 and 32 of support 12. Mounting tabs 38 are preferably made from a resiliently flexible material and are sized and configured so as to resiliently flex away from backing 36 upon slidably receiving flanges 30 and 32 of support 12. As best shown by FIG. 11, tabs 38 resiliently return towards their initial shape so as to frictionally clamp pad 14 to flanges 30 and 32 of support 12. As best shown by FIG. 7, mounting tabs 38 are preferably spaced from one another along the longitudinal length of backing 36 and pad 14. As will be appreciated, the exact number and length of mounting tabs 38 along the front and rear sides 24 and 26 of pad 14 may be varied depending upon the resiliency of the mounting tabs, the amount of surface contact between support 12 and pad 14 and the desired degree of hold between support 12 and pad 14. In the exemplary embodiment illustrated, tabs 38 are integrally formed out of polyvinyl chloride with backing 36. Alternatively, mounting tabs 38 may be individually formed and otherwise secured to backing 36. Furthermore, in lieu of mounting tabs 38, backing 36 may be provided with various other means for removably attaching pad 14 to support 12 such as mechanical fasteners, hook and loop systems, releasable adhesives or mechanical interlocking structures.

Substrate 40 comprises a layer of supporting material coupled to backing 36 opposite mounting tabs 38. Substrate 40 supports applicating medium 42. Substrate 40 preferably comprises a layer of material having a limited degree of compressibility such that surface 28 of medium 42 is maintained in an arcuate convex shape when normal pressure is applied to applicator 10. Substrate 40 is preferably resiliently deformable so as to deform with backing 36 when backing 36 is mounted adjacent to support 12. Consequently, applicating medium 42 extending along substrate 40 also deforms so as to have an arcuate convex cross-sectional profile. Front 24 and rear 26 of substrate 40 are preferably arcuate so as to avoid cracking or degradation due to the resilient deformation of substrate 40 when pad 14 is mounted to support 12. Front 24 and rear 26 each preferably have a radius of approximately 0.75 inches. In the exemplary embodiment, substrate 40 is formed from closed cell foam such as polyester-based polyurethane foam. Substrate 40 is preferably bonded to backing 36 by a solvent-resistant two-part epoxy system comprising a base resin and activator. Alternatively, substrate 40 may be bonded to backing 36 by urethane or various other adhesives. Although presently viewed as less desirable, substrate 40 may also be coupled to backing 36 by various mechanical fasteners and interlocking structures. For example, substrate 40 may be comolded with backing 36 depending upon the material selected for backing 36 and substrate 40. In the exemplary embodiment, substrate 40 preferably has a thickness of 0.5 inches.

Applicating medium 42 extends along substrate 40 opposite backing 36 and defines surface 28 as well as front side 24 and rear side 26 of pad 14. Applicating medium 28 comprises a liquid coating medium capable of retaining, releasing and spreading coating across a surface 16 which may comprise roughened concrete, polymers or woodgrain such as those found in driveways and decks. Applicating medium 42 preferably comprises a layer of flocking. Flocking comprises a fabric of individual filaments or fibers which are bonded to substrate 40. In the exemplary embodiments illustrated, flocking may comprise any one of a variety of materials such as acrylic, modacrylic, cotton, wool, polyester, other polyolofines, nylon, rayon, mohair, and others. The flocking preferably has a minimum height of at least 0.03 inches. The flocking preferably has a pile height of approximately 0.180 inches and a density between about 15 to 25 ends per inch. Preferably, 21 ends per inch are employed. In the exemplary embodiment illustrated, applicating medium 42 comprises nylon flock which is specially coated to hold electric charge and which is bonded to substrate 40 using a solvent resistant adhesive such as modified plasticol or acrylics. Alternatively, the flocking material of application medium 42 may be bonded to substrate 40 with various other adhesives.

Because applicating medium 42 preferably comprises a layer of flocking material, applicator 10 is advantageous over conventional fabric nap roller applicators employing fabric nap and flat applicators employing sponge material. First, only the ends of the individual filaments or fibers of applicating medium 42 frictionally contact surface 16. As a result, pad 14 has a lower coefficient of friction such that applicator 10 may be more easily moved across surface 16 during the application of coatings. Second, because applicating medium 42 preferably comprises flocking, applicating medium 42 has a greater three-dimensional surface area to hold and retain liquid coatings as compared to fabric nap or sponge material. As a result, applicating medium 42 of pad 14 is better able to hold low viscosity fluids such as those containing water sealants and the like which are frequently used to coat decks and driveways. Third, the flocking material of pad 14 more uniformly deposits and releases liquid coating to surface 16 at a better and more controllable rate. Fourth, because the individual fibers of the flocking material are able to individually deflect, the flocking material better conforms to high and low points in surface 16 being coated. As a result, pad 14 is better adapted to spread coatings to roughened surfaces such as those frequently found on decks and driveways.

FIGS. 9 through 11 illustrate pad 14 mounted to support 12. As best shown by FIG. 9, support 12 generally includes front wall portion 52, rear wall portion 54, intermediate wall portion 56 and ribs 58. Front wall portion 52 extends from front flange 30 while rear wall portion 54 extends from rear flange 32. Intermediate wall portion 56 interconnects front wall portion 52 and rear wall portion 54 opposite pad 14. As a result, walls 52, 54 and 56 form a hollow lightweight structure that is also sufficiently stiff so as to adequately support pad 14 as liquid coating applicator 10 is moved across surface 16. Although walls 52, 54 and 56 form a semi-cylindrical half-pipe extending along the longitudinal length of support 12, walls 52, 54 and 56 may alternatively be configured so as to have square or rectangular cross-sectional shapes that extend along the longitudinal length of support 12. The semi-spherical cross-sectional shape of support 12 provides a sleek, robust and visually attractive appearance.

Ribs 58 extend between walls 52, 54 and 56 into engagement with pad 14. In the exemplary embodiment, support 12 includes four such ribs 58 spaced between longitudinal ends of support 12. In particular, support 12 includes a rib 58 at each of locations 62, 64, 66 and 68 as indicated in FIG. 4. Each of ribs 58 includes a lower edge or surface 70 configured so as to engage and contact backing 36 of pad 14.

FIGS. 10 and 11 are enlarged sectional views illustrating the engagement of rib 58 with pad 14 in greater detail. As shown by FIGS. 10 and 11, surface 70 of rib 58 has an arcuate convex contour such that surface 70 engages backing 36 of pad 14 to deform backing 36, substrate 40 and applicating medium 42 into a corresponding arcuate convex cross-sectional shape or contour. Preferably, surface 70 of rib 58 has a radius of between at least 5 inches and 27 inches. Surface 70 more optimally has a radius of between about 12 inches and 20 inches. In the exemplary embodiment illustrated, surface 70 has a radius of approximately 21 inches. Because surfaces 70 of rib 58 engage and deform backing 36, substrate 40 and applicating medium 42, pad 14 can be manufactured with a generally flat backing 36 such that the manufacture of pad 14 is less complex and less expensive.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A liquid coating applicator comprising:

a support;

a pad slidably coupled to the support, the pad having a front side, a rear side, and a lower arcuate convex surface between the front side and the rear side to spread coatings, wherein the pad includes:

a backing configured to be coupled to the support; and a flocking material coupled to the backing; and an elongate pole, the support including a mounting portion configured to be coupled to the pole and a plurality of spaced ribs, each rib having an arcuate convex surface in engagement with the backing.

2. The applicator of claim 1, wherein the arcuate convex surface has a radius of at least 5 inches.

3. The applicator of claim 1, wherein the arcuate convex surface has a radius of between about 5 inches and 27 inches.

4. The applicator of claim 1, wherein the arcuate convex surface has a radius of between about 12 inches and 20 inches.

5. The applicator of claim 1, wherein the arcuate convex surface has a radius of approximately 21 inches.

6. The applicator of claim 1, including:

a substrate coupled to the backing, wherein the flocking material is coupled to the substrate.

7. The applicator of claim 6, wherein the support is configured to engage and deform the substrate such that the substrate has an arcuate convex cross-section.

8. The applicator of claim 1, wherein the pad is flexible so as to deform to an arcuate convex shape.

9. The applicator of claim 1, wherein the pad is removably coupled to the support.

10. The applicator of claim 9, wherein the pad slidably mounts to the support.

11. The applicator of claim 9, wherein the pad includes a plurality of resiliently flexible longitudinally spaced tabs that form a channel to releasably receive the support.

12. The applicator of claim 1, wherein the support includes:

the first wall portion extending from the pad;

a second wall portion extending from the pad; and a third wall portion interconnecting the first and second wall portions opposite the pad.

13. The applicator of claim 1, wherein each rib is provided by a single continuous member.

14. A coating applicator support for use with an applicator pad, the support comprising:

a body having a longitudinal length extending from side to side, a transverse width extending from a front to a rear, and at least one pad engaging surface, wherein said at least one pad engaging surface is configured to slidably engage the pad, the body including a plurality of ribs longitudinally spaced from one another, each rib having an arcuate convex surface configured to support the pad in an arcuate convex cross-sectional shape; and an elongate pole, the support including a mounting portion configured to be coupled to the pole.

15. The applicator support of claim 14, wherein each rib includes said at least one pad engaging surface.

16. The applicator support of claim 15, wherein the support includes:

a first wall portion having a first end and a second end adapted to be coupled to the pad;

a second wall portion having a first end and a second end adapted to be coupled to the pad; and a third wall portion interconnecting the first ends of the first and second wall portions and extending opposite the pad.

17. The applicator support of claim 14, wherein said at least one pad engaging surface is configured to support the pad in an arcuate convex cross-sectional shape having a radius of at least 5 inches.

18. The applicator support of claim 14, wherein said at least one pad engaging surface is configured to engage the pad and support the pad in an arcuate convex cross-sectional shape having a radius of between approximately 5 inches and 27 inches.

19. The applicator support of claim 14, wherein said at least one pad engaging surface is configured to engage the pad and support the pad in an arcuate convex cross-sectional shape having a radius of between approximately 12 inches and 20 inches.

20. The applicator support of claim 14, wherein said at least one pad engaging surface is configured to engage the pad and support the pad in an arcuate convex cross-sectional shape having a radius of approximately 21 inches.

21. The applicator in support of claim 14, wherein each rib is provided by a single continuous member.

22. A liquid coating applicator comprising:

a support;

a pad coupled to the support, the pad having a front side, a rear side, and a lower arcuate convex surface between the front side and the rear side to spread coatings;

the pad including a backing configured to be coupled to the support; and a flocking material coupled to the backing; and the support includes a plurality of spaced ribs, each rib having an arcuate convex surface in engagement with the backing.

23. The applicator in support of claim 22, wherein each rib is provided by a single continuous member.

24. A coating applicator support for use with an applicator pad, the support comprising:

a body having a longitudinal length extending from side to side, a transverse width extending from a front to a rear, and at least one pad engaging surface, wherein said at least one pad engaging surface is configured to engage the pad and to support the pad in an arcuate convex cross-sectional shape; and a plurality of longitudinally spaced ribs, wherein each rib includes said at least one pad engaging surface.

25. The applicator support of claim 24, wherein the support includes:

a first wall portion having a first end and a second end adapted to be coupled to the pad;

a second wall portion having a first end and a second end adapted to be coupled to the pad; and a third wall portion interconnecting the first ends of the first and second wall portions and extending opposite the pad.

26. The applicator in support of claim 24, wherein each rib is provided by a single continuous member.

* * * * *